US005117654A

United States Patent [19]

Steffenhagen

[11] Patent Number: 5,117,654

[45] Date of Patent: Jun. 2, 1992

[54] ICE CONVEYOR SYSTEM FOR REFRIGERATOR

[75] Inventor: Mark G. Steffenhagen, Knight Township, Vanderburgh County, Ind.

[73] Assignee: Whirlpool Corporation, Benton Harbor, Mich.

[21] Appl. No.: 720,269

[22] Filed: Jun. 24, 1991

[51] Int. Cl.[5] ..... B65G 33/02

[52] U.S. Cl. ..... 62/344; 198/661; 198/670; 198/676; 222/412

[58] Field of Search ..... 62/344; 198/661, 670, 198/676; 222/412, 413

[56] References Cited

U.S. PATENT DOCUMENTS

| | | | |
|---|---|---|---|
| 3,180,525 | 4/1965 | Fabian et al. | 222/412 X |
| 3,197,814 | 8/1965 | Bond, Jr. et al. | 198/676 X |
| 3,422,994 | 1/1969 | Alvarez | 222/240 |
| 3,437,244 | 4/1969 | Alvarez et al. | 222/240 |
| 3,537,132 | 11/1970 | Alvarez | 62/266 |
| 3,537,273 | 11/1970 | Alvarez | 62/266 |
| 3,537,618 | 11/1970 | Alvarez | 222/333 |
| 3,602,406 | 8/1971 | Jacobus et al. | 222/413 |
| 3,602,441 | 8/1971 | Alvarez | 241/101 |
| 3,843,067 | 10/1974 | Prada | 241/190 |
| 3,913,798 | 10/1975 | Allen | 222/412 X |
| 4,084,725 | 4/1978 | Buchser | 221/75 |
| 4,619,380 | 10/1986 | Brooks | 222/240 |
| 4,627,556 | 12/1986 | Brooks | 222/240 |

*Primary Examiner*—William E. Tapolcai
*Attorney, Agent, or Firm*—Wood, Phillips, VanSanten, Hoffman & Ertel

[57] ABSTRACT

An ice dispenser for a refrigeration apparatus includes a container for storing ice bodies. The container has opposite front and rear walls and an access opening through the front wall. A housing is secured at the front wall adjacent the access opening and has a dispensing space for dispensing ice bodies. An ice conveyor transfers ice bodies stored in the container to the dispensing space. The ice conveyor includes a wire auger and a cylindrical sleeve surrounding the wire auger for rotation therewith. The cylinder has an outer wall including a helical rib extending outwardly therefrom. The sleeve rib moves ice bodies frontwardly at a slower rate than the wire auger.

19 Claims, 2 Drawing Sheets

ICE CONVEYOR SYSTEM FOR REFRIGERATOR

FIELD OF THE INVENTION

This invention relates to an ice dispensing apparatus and, more particularly, to an improved conveying means therefor.

BACKGROUND OF THE INVENTION

In one form of ice body making apparatus, an automatic ice maker is provided for forming ice bodies and periodically delivering the formed ice bodies into a subjacent container maintained within a freezer space of a refrigeration apparatus. In one conventional form, the ice bodies are removed from the container by a user grasping the ice bodies through an open top of the container and removing the desired quantity.

In another form of a refrigeration apparatus, a through-the-door ice dispenser is provided for automatically delivering the desired quantity of formed ice bodies from the container into a suitable receptacle, such as a glass or pitcher. Such an apparatus includes a conveying means for conveying ice bodies stored in the container to a discharge chute in the door. Typically, the ice bodies are delivered from the container to a transfer mechanism by means of a wire auger which is rotated by a motor at the rear end of the auger. The forward end of the auger is connected to the transfer mechanism which transfers the ice bodies seriatim to a subjacent transfer chute leading to the dispensing area. Actuation of the drive motor may be effected by suitable switches connected to dispensing means at the dispensing portion adapted to received by the glass or pitcher ice body collector, so that the desired quantity of ice bodies may be delivered automatically by the maintained energization of the drive motor.

With the above-described ice dispenser, the wire auger conveys ice bodies to the front of the container quicker than they are dispensed. As a result, ice bodies can pile up at the front of the container causing ice dispensing problems and interference with the ice maker control system.

The present invention is intended to overcome one or more of the problems discussed above.

SUMMARY OF THE INVENTION

There is disclosed herein an ice dispenser for a refrigeration apparatus including means for slowing the conveying of ice bodies therein.

Broadly, there is disclosed herein an ice dispenser for a refrigeration apparatus which includes a container for storing ice bodies. The container has opposite front and rear walls and an access opening through the front wall. A housing is secured at the front wall adjacent the access opening and has a dispensing space for dispensing ice bodies. An ice conveyor transfers ice bodies stored in the container to the dispensing space. The ice conveyor includes a wire auger having a front end and a rear end and front mounting means for rotatably mounting the auger front end adjacent the front wall access opening of the container. A cylindrical sleeve operatively engages the wire auger rear end for rotation therewith and has an outer wall including a helical rib extending outwardly therefrom. Rear mounting means rotatably mount the sleeve at the rear wall coaxial with the auger. A drive means operatively engages the rear mounting means for rotating the sleeve and the wire auger to deliver ice bodies from the container to the dispensing space, the sleeve rib moving ice bodies frontwardly at a slower rate than the wire auger.

It is a feature of the invention that the sleeve is tubular defining an inner cylindrical space and the wire auger rear end is received in the space.

It is another feature of the invention that the sleeve rib has a greater number of turns per unit length than the wire auger.

It is a further feature of the invention that the rear mounting means comprises a coupler engaging the wire auger rear end and the sleeve.

It is still another feature of the invention that the rib has an outer, frontmost edge defining a sharp angle.

More specifically, the sleeve comprises a plastic molded part that slips over the wire auger. The helical rib includes a plurality of turns defining a pitch angle smaller than a pitch angle of the wire auger. The height of the rib is substantially less than the thickness of the wire of the wire auger. The short ribs of the sleeve and the smaller pitch angle move the ice bodies more slowly to reduce the piling action of the ice bodies at the front of the container.

In accordance with the invention, the sleeve can be mounted on existing ice dispensers or factory installed.

Further features and advantages of the invention will readily be apparent from the specification and from the drawings.

DETAILED DESCRIPTION OF THE INVENTION

Figure 1:
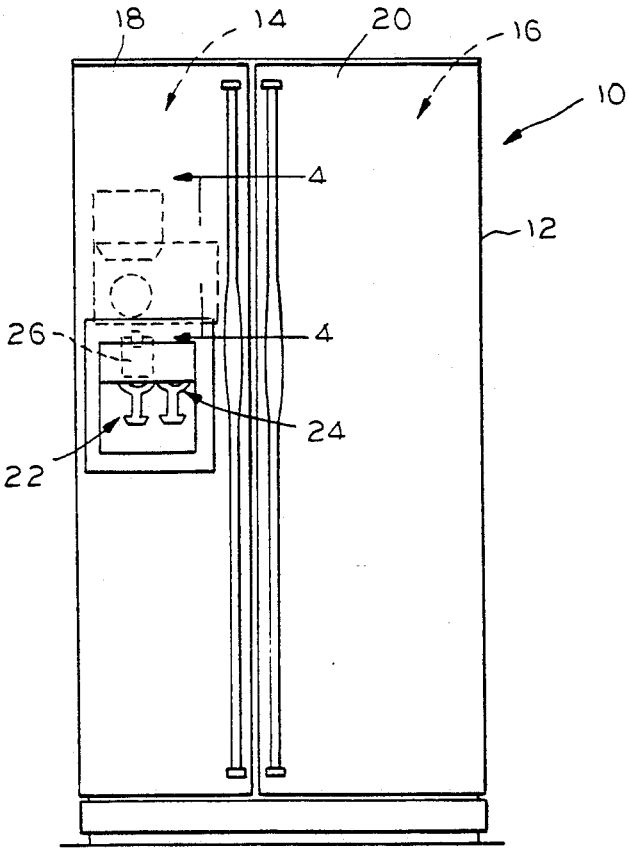
FIG. 1 is an elevation view of a refrigeration apparatus including a through-the-door ice and water dispenser.
Figure 2:
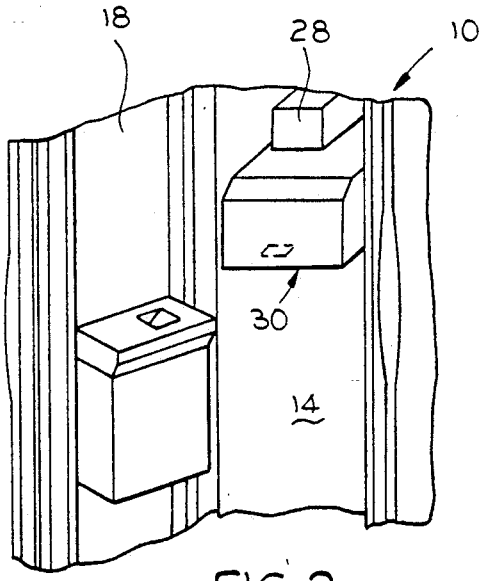
FIG. 2 is a perspective view of the refrigeration apparatus of FIG. 1 with the freezer door in an open position.

With reference to FIGS. 1 and 2, a refrigeration apparatus 10, comprising a side-by-side refrigerator/freezer, includes a cabinet 12 providing a below-freezing, or freezer, compartment 14, and an above-freezing, or fresh food, compartment 16. Access to the compartments 14 and 16 is had through respective freezer and refrigerator doors 18 and 20 hingedly mounted to the cabinet 12, as is well known.

The freezer door 18 is provided with a through-the-door ice and water dispenser 22. Specifically, the dispenser 22 includes a water chute 24 through which water is automatically transferred to any receptacle position therebelow, and an ice chute 26 through which ice bodies may be automatically transferred. In the illustrated embodiment, the ice bodies may be fully formed ice bodies or crushed ice bodies.

As specifically shown in FIG. 2, the freezer compartment 14 houses a conventional ice body making apparatus 28 which delivers formed ice bodies into a subjacent ice container assembly 30 embodying the invention.

The ice container assembly 30 comprises a container 32 for storing formed ice bodies. The container 32 has opposite side walls, one of which 34 is shown, connected to a rear wall 36 and a front wall 38. Each of the walls 34, 36 and 38 are connected to a bottom wall 40. A front access opening 42 is provided through the front wall 38. A housing 44 is secured to the front wall 38 surrounding the opening 42 and includes a lower open dispensing space 46 for delivering formed or crushed ice bodies to the ice chute 26, as illustrated. Particularly, with the freezer door 18 in a closed position, the dispensing space 44 is located immediately above the ice chute 26. The ice container assembly 30 includes an ice conveyor 48 for transferring ice bodies stored in the container 32 to the dispensing space 46.

The ice conveyor 48 comprises a wire auger 50, a sleeve 52 and a transfer mechanism 54. The transfer mechanism 54 includes a rotatable drum dispenser 56 and is contained in the housing 44.

The wire auger 50 comprises an elongated wire helically wound to form a spiral and having a front end 58 and a rear end 60. The rear end 60 is received by an auger coupler 62 operatively connected to an output shaft of a motor drive 64 for rotating the wire auger 50. The wire auger front end 58 defines an elongate drive shaft driving the drum dispenser 56. The drum dispenser 56 is provided with an axial tubular hub 66 carried in an annular boss 68 on a front wall 70 of the housing 44. Thus, the drum dispenser 56 effectively rotatably mounts the auger front end 58 adjacent the front wall access opening 42.

Figure 4:
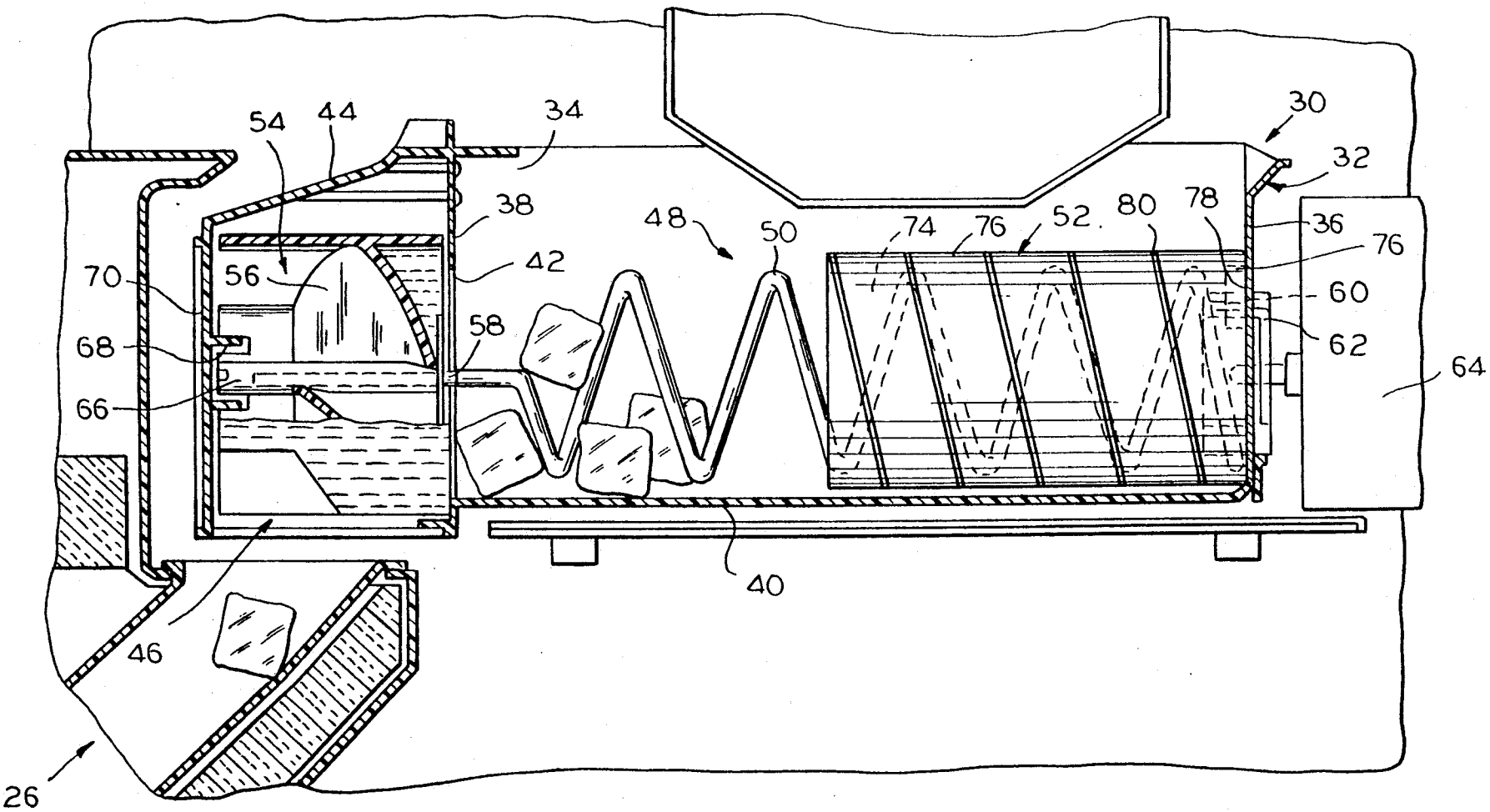
FIG. 4 is a fragmentary enlarged vertical section taken substantially along the line 4—4 of FIG. 1.

The cylindrical sleeve 52 comprises a tubular sleeve having an outer wall 72 defining an inner cylindrical space 74. The wire auger rear end 60 is received in the space 74, as illustrated in phantom in FIG. 4. The coupler 62 is received in an open end of the sleeve 52 to maintain coaxial with the auger 50. The sleeve 52 includes an inwardly extending notch or rib 76 extending inwardly from the wall 72 at a rear portion thereof. The notch 76 is engaged by a right angle bend 78 at the wire auger rear end 60. The wire auger bend 78 acting on the step 76 causes the sleeve 52 to rotate with the wire auger 50. The outer wall 72 includes a helical rib 80 extending outwardly therefrom.

The wire auger 50 defines a first pitch angle and the helical rib 80 defines a second pitch angle, less than the first pitch angle. Stated differently, the sleeve rib 80 has a greater number of turns per unit than the wire auger 50. The turns of the rib 80 and the auger 50 are oriented in the same direction.

Figure 5:
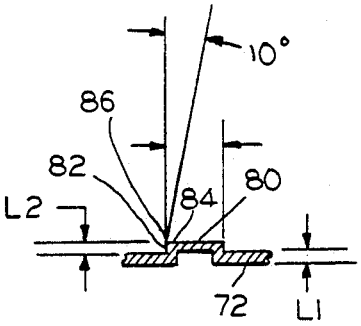
FIG. 5 is a sectional view taken along the line 5—5 of FIG. 3.
Figure 3:
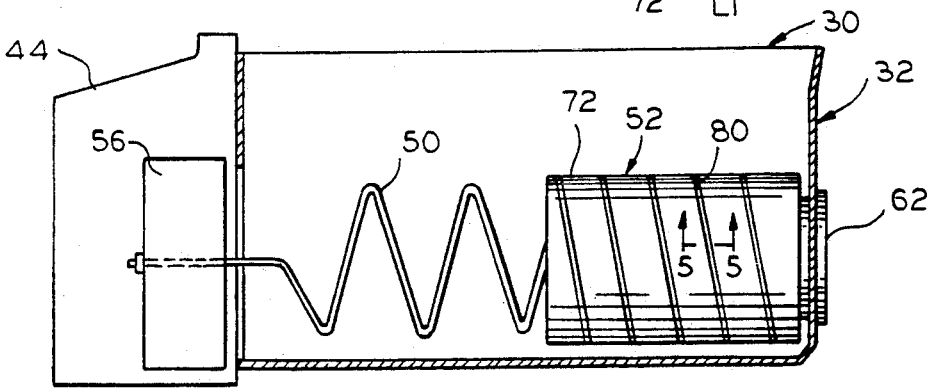
FIG. 3 is a side, partial sectional view of the ice dispenser of FIG. 1 according to the invention.

In accordance with the invention, the sleeve 52 is a plastic molded sleeve that slips over the auger 50. With reference to FIG. 5, the outer wall 72 is of a select thickness L1 substantially equal to a thickness L2 of the rib 80. The rib 80 has a front surface 82 approximately 10° offset from a right angle to facilitate molding. An upper corner edge 86, defined by an intersection between the front surface 82 and an outer surface 84 defines a sharp angle, i.e. not rounded.

In accordance with the invention, the pitch angle of the helical rib 80 is approximately half that of the wire auger 50. Further, the height L1 of the rib 80 is approximately one millimeter. The combination of the rib pitch angle and rib height slows the advance of ice bodies to a desired amount to relieve pile-up problems at the front of the container 32. The sharp edge 86 prevents rolloff of ice bodies as they are advanced by the rib 80. The height 61 of the rib 80 is substantially less than the thickness of the wire used for the auger 50.

The sleeve 52 can be used on ice dispensers for dispensing ice bodies only or ice bodies and crushed ice, and can be factory installed or installed on already existing ice dispensers in the field.

Thus, the ice conveyor 48 in accordance with the invention alleviates the problem of ice piling up at the access opening 42 which could cause ice dispensing problems and interfere with the ice maker control system.

Further features and advantages of the invention will readily be apparent from the specification and from the drawings.

I claim:

1. An ice dispenser for a refrigeration apparatus, comprising:

a container, for storing ice bodies, said container having opposite front and rear walls and an access opening through said front wall;

a housing secured at the front wall adjacent said access opening and having a dispensing space for dispensing ice bodies;

an ice conveyor for transferring ice bodies stored in said container to said dispensing space, including a wire auger having a front end and a rear end, front mounting means for rotatably mounting said auger front end adjacent the front wall access opening of said container, a cylindrical sleeve operatively engaging said wire auger rear end for rotation therewith and having an outer wall including a helical rib extending outwardly therefrom, and rear mounting means for rotatably mounting said sleeve at said rear wall coaxial with said auger; and drive means operatively engaging said rear mounting means for rotating said sleeve and said wire auger to deliver ice bodies from said container to said dispensing space, said sleeve rib moving ice bodies frontwardly at a slower rate than said wire auger.

2. The ice dispenser of claim 1 wherein said sleeve is tubular defining an inner cylindrical space and said wire auger rear end is received in said space.

3. The ice dispenser of claim 1 wherein said sleeve rib has a greater number of turns per unit length than said wire auger.

4. The ice dispenser of claim 1 wherein said rear mounting means comprises a coupler engaging said wire auger rear end and said sleeve.

5. The ice dispenser of claim 1 wherein said rib has an outer, frontmost edge defining a sharp angle.

6. An ice dispenser for a refrigeration apparatus, comprising:

a container for storing ice bodies, said container having opposite front and rear walls and an access opening through said front wall;

a housing secured at the front wall adjacent said access opening and having a dispensing space for dispensing ice bodies;

an ice conveyor for transferring ice bodies stored in said container to said dispensing space, including a wire auger comprising a wire having a front end and a rear end and a plurality of turns therebetween defining a first pitch angle, front mounting means for rotatably mounting said auger front end adjacent the front wall access opening of said container, a cylindrical sleeve operatively engaging said wire auger rear end for rotation therewith and having an outer wall including a helical rib extending outwardly therefrom, said rib including a plurality of turns defining a second pitch angle smaller than said first pitch angle, and rear mounting means for rotatably mounting said sleeve at said rear wall coaxial with said auger; and drive means operatively engaging said rear mounting means for rotating said sleeve and said wire auger to deliver ice bodies from said container to said dispensing space.

7. The ice dispenser of claim 6 wherein said sleeve is tubular defining an inner cylindrical space and said wire auger rear end is received in said space.

8. The ice dispenser of claim 6 wherein said rear mounting means comprises a coupler engaging said wire auger rear end and said sleeve.

9. The ice dispenser of claim 6 wherein said rib has an outer, frontmost edge defining a sharp angle.

10. An ice dispenser for a refrigeration apparatus, comprising:

a container for storing ice bodies, said container having opposite front and rear walls and an access opening through said front wall;

a housing secured at the front wall adjacent said access opening and having a dispensing space for dispensing ice bodies;

an ice conveyor for transferring ice bodies stored in said container to said dispensing space, including a wire auger having a front end and a rear end, front mounting means for rotatably mounting said auger front end adjacent the front wall access opening of said container, a cylindrical sleeve operatively engaging said wire auger rear end for rotation therewith and having an outer wall including a helical rib extending outwardly therefrom, said rib having a height less than a thickness of said wire auger, and rear mounting means for rotatably mounting said sleeve at said rear wall coaxial with said auger; and drive means operatively engaging said rear mounting means for rotating said sleeve and said wire auger to deliver ice bodies from said container to s id dispensing space.

11. The ice dispenser of claim 10 wherein said sleeve is tubular defining an inner cylindrical space and said wire auger rear end is received in said space.

12. The ice dispenser of claim 10 wherein said sleeve rib has a greater number of turns per unit length than said wire auger.

13. The ice dispenser of claim 10 wherein said rear mounting means comprises a coupler engaging said wire auger rear end and said sleeve.

14. The ice dispenser of claim 10 wherein said rib has an outer, frontmost edge defining a sharp angle.

15. In an ice dispenser for a refrigeration apparatus including a container for storing ice bodies, said container having a front access opening, a housing secured at the front access opening and having a dispensing space for dispensing ice bodies, and an ice conveyor for transferring ice bodies stored in said container to said dispensing space, including a wire auger having a front end rotatably mounted adjacent the front access opening and a rear end rotatably coupled at a rear wall of said container and a drive for rotating said wire auger to deliver ice bodies from said container to said dispensing space, the improvement comprising:

a cylindrical sleeve having an axial length less than that of the wire auger operatively engaging said wire auger rear end for rotation therewith and having an outer wall including a helical rib extending outwardly therefrom, said sleeve rib moving ice bodies frontwardly at a slower rate than said wire auger.

16. The improvement of claim 15 wherein said sleeve is tubular defining an inner cylindrical space and said wire auger rear end is received in said space.

17. The improvement of claim 15 wherein said sleeve rib has a greater number of turns per unit length than said wire auger.

18. The improvement of claim 15 wherein said rear mounting means comprises a coupler engaging said wire auger rear end and said sleeve.

19. The improvement of claim 15 wherein said rib has an outer, frontmost edge defining a sharp angle.

* * * * *